United States Patent [19]

Gallant et al.

[11] Patent Number: 4,893,440

[45] Date of Patent: Jan. 16, 1990

[54] ABRASIVE JET MACHINING

[75] Inventors: Ben J. Gallant, Corpus Christi, Tex.; Walter G. Kulischenko, East Brunswick, N.J.

[73] Assignee: Airsonics License Partnership, Corpus Christi, Tex.

[21] Appl. No.: 355,880

[22] Filed: May 19, 1989

Related U.S. Application Data

[60] Continuation of Ser. No. 148,387, Jan. 25, 1988, abandoned, which is a division of Ser. No. 858,373, May 1, 1986, Pat. No. 4,733,503.

[51] Int. Cl.[4] ..... B24C 7/00

[52] U.S. Cl. ..... 51/436; 51/413

[58] Field of Search ..... 51/436, 413, 415, 410, 51/417, 421, 424–425, 438

[56] References Cited

U.S. PATENT DOCUMENTS

| | | | |
|---|---|---|---|
| 2,128,585 | 8/1938 | Hannay et al. | 291/25 |
| 2,588,212 | 3/1952 | Custer | 251/5 |
| 2,908,476 | 10/1959 | Hidding | 251/284 |
| 3,139,705 | 7/1964 | Histed | 51/436 |
| 3,149,759 | 9/1964 | Manley | 222/193 |
| 3,230,016 | 1/1966 | Gilbert et al. | 302/53 |
| 3,350,053 | 10/1967 | Schmitz | 251/5 |
| 3,415,276 | 12/1968 | Lind et al. | 251/7 |
| 3,425,166 | 2/1969 | Best et al. | 51/413 |
| 3,429,549 | 2/1969 | Swanson | 251/4 |
| 3,490,732 | 1/1970 | Leroy | 251/5 |
| 3,511,469 | 5/1970 | Bell | 251/7 |
| 3,516,204 | 6/1970 | Kulischenko | 51/413 |
| 3,534,503 | 10/1970 | Kulischenko | 51/8 |
| 3,577,682 | 5/1971 | Kulischenko | 51/8 |
| 3,589,081 | 6/1971 | Kulischenko | 51/319 |
| 3,593,459 | 7/1971 | Kulischenko | 51/8 |
| 3,710,515 | 1/1973 | Kulischenko et al. | 51/8 |
| 3,759,483 | 9/1973 | Baxter | 251/5 |
| 3,866,357 | 2/1975 | Callahan et al. | 51/415 |
| 3,982,724 | 9/1976 | Citrin | 251/7 |
| 3,991,972 | 11/1976 | Eaton | 251/11 |
| 4,044,989 | 8/1977 | Basel et al. | 251/7 |
| 4,081,170 | 3/1978 | Doss, Jr. | 251/5 |
| 4,177,969 | 12/1979 | Sieber-Muller | 251/9 |
| 4,322,054 | 3/1982 | Campbell | 251/5 |

FOREIGN PATENT DOCUMENTS

| | | | |
|---|---|---|---|
| 1960102 | 6/1971 | Fed. Rep. of Germany . | |
| 2261001 | 8/1973 | Fed. Rep. of Germany | 51/421 |
| 1347455 | 12/1963 | France . | |
| 69621 | 4/1983 | Japan . | |
| 479919 | 12/1975 | U.S.S.R. . | |
| 496410 | 12/1976 | U.S.S.R. . | |
| 693028 | 6/1953 | United Kingdom . | |
| 1058273 | 2/1967 | United Kingdom . | |
| 1569827 | 6/1980 | United Kingdom . | |
| 2042128 | 9/1980 | United Kingdom . | |

OTHER PUBLICATIONS

IBM Technical Disclosure Bulletin, vol. 12, No. 8, p. 1153—Manner et al.

*Primary Examiner*—Robert Rose

*Attorney, Agent, or Firm*—Kenneth P. Synnestvedt

[57] ABSTRACT

Apparatus for developing and handling an abrasive-laden gas stream for abrasive jet machining, employing equipment for storage, feeding, and control of abrasive powder in a carrier jet delivered through an upright feed tube at relatively high pressure and velocity.

5 Claims, 4 Drawing Sheets

CHAMBER BLEED-OFF
N.O.
N.C.
SOL.
GAS IN
VIB ADJ.
DELAY FOR VALVE CLOSURE

ABRASIVE JET MACHINING

This is a continuation of co-pending application Ser. No. 148,387, filed on Jan. 25, 1988, which is a division of Ser. No. 858,373, filed May 1, 1986, now U.S. Pat. No. 4,733,503.

CROSS REFERENCE

This invention relates to abrasive jet machining and is particularly concerned with improvements in equipment of the kind disclosed in copending application of one of the present Applicant's, namely, Ben J. Gallant, Ser. No. 830,686 filed Feb. 18, 1986, now U.S. Pat. No. 4,708,534.

BACKGROUND AND STATEMENT OF OBJECTS

The present invention is particularly concerned with the provision of equipment for abrasive jet machining providing for employment of a jet of relatively high pressure and high velocity.

Although the equipment disclosed in the present application may be employed with a pressurized gas stream at any desired pressure, the equipment of the present invention is of special importance for use where relatively high gas pressure is contemplated.

In typical abrasive jet equipment heretofore employed, the pressure of the gas has usually been lower than about 200 PSI. For many purposes, it would be desirable to utilize a pressure running up to at least several hundred PSI.

It has been known that increasing the pressure of the gas stream in an existing feed tube and nozzle results in increase of the velocity of flow through the feed tube and the delivery nozzle. With the same pressure, if the cross-sectional flow area of the delivery nozzle were appreciably reduced, the ratio of the particles to the volume of the gas would no longer form a workable combination in relation to the gas velocity and mass of the abrasive particles. The invention contemplates reducing the cross-sectional flow area of the nozzle and preferably some reduction in the cross-sectional flow area of the feed tubing. In this way appropriate conditions for the abrasion are provided notwithstanding the increase in velocity of flow.

The present invention also contemplates employment of a novel form of feed tube and delivery nozzle making practical the employment of much higher pressures than employed heretofore, and the accompanying higher velocities of flow resulting from the increase in pressure.

The various features of the present invention illustrated in the drawings and fully described hereinafter result in the provision of equipment well adapted to the handling and use of an abrasive stream at a pressure in excess of 200 PSI, for instance, of the order of 300 or 400 PSI. The equipment of the present invention may also be used at even higher pressure, running up at least to about 2000 PSI. The use of these higher pressures greatly increases the production rate of the manufacturing components, but with the prior equipment, such increases of the operating pressure is not practical for a number of reasons, especially the resultant increase in the rate of wear of various of the manufacturing components, especially the tubing through which the abrasive-laden pressurized stream is delivered.

The present invention also provides for the handling of a much wider variety of particles and particle sizes than is practicable in prior known equipment. The particles may comprise any of a wide variety of materials including for example aluminum oxide or silicon carbide.

The present invention provides a novel form of abrasive flow tubing having improved capability of handling high pressure and high velocity flow. Thus, according to the present invention, the pressurized stream of abrasive-laden gas is carried in straight line tubing preferably extended in a vertical direction, desirably vertically downwardly, from the point of development of the pressurized gas stream to the delivery orifice of the abrasive nozzle employed. This makes possible extensive increase in pressure and velocity, without correspondingly increasing the wear of the tubing.

According to the invention, this vertical abrasive delivery duct or tubing is formed of rigid material such as carbide or metal, without the employment of any zones of flexible rubber or plastic tubing of the kind heretofore employed in abrasive jet machines, in order to deliver the abrasive-laden stream from the point of generation to the point of discharge through the nozzle delivery orifice. In equipment adapted for use at pressures commonly employed, for instance up to about 100 or even 200 PSI, the abrasive delivery duct may be formed of any rigid material, such as metal tubing, but if pressures substantially in excess of 200 PSI are contemplated it is preferred to use more highly abrasive resistant materials such as carbides, for instance tungsten carbide, boron carbide or certain ceramics, such as saphire.

By the employment of the straight line, preferably downwardly extended tubing, the abrasive wear to which the tubing is subjected is reduced, even at high pressures equal to many times the pressures heretofore employed. In consequence, such tubing in the equipment of the present invention has long life, notwithstanding the employment of the high pressure and high velocity flow within the tubing.

Having in mind the foregoing straight line vertical feed of the high pressure abrasive-laden gas stream, the equipment of the present invention is arranged and mounted in a novel manner. Thus, it is contemplated according to the invention to mount the abrasive stream generating equipment itself on a base or standard with the vertical delivery nozzle projecting downwardly; and it is an object of the invention to provide a work support moveable in a horizontal plane in a zone beyond the delivery opening of the abrasive nozzle.

The invention also contemplates mounting of the abrasive jet generating equipment by a mechanism providing for vertical adjustment of the nozzle in relation to the work support.

Still further, the invention contemplates certain novel forms of controls for interrelating the motions of the work support in relation to the abrasive stream being generated, and also contemplates certain interrelated controls providing for starting and stopping of the abrasive stream, without subjecting the equipment to excessive wear, even when employing very high pressure jet flow.

BRIEF DESCRIPTION OF THE DRAWINGS

With the foregoing in mind, attention is directed to the accompanying drawings in which.

DETAILED DESCRIPTION OF THE DRAWINGS

Figure 1:
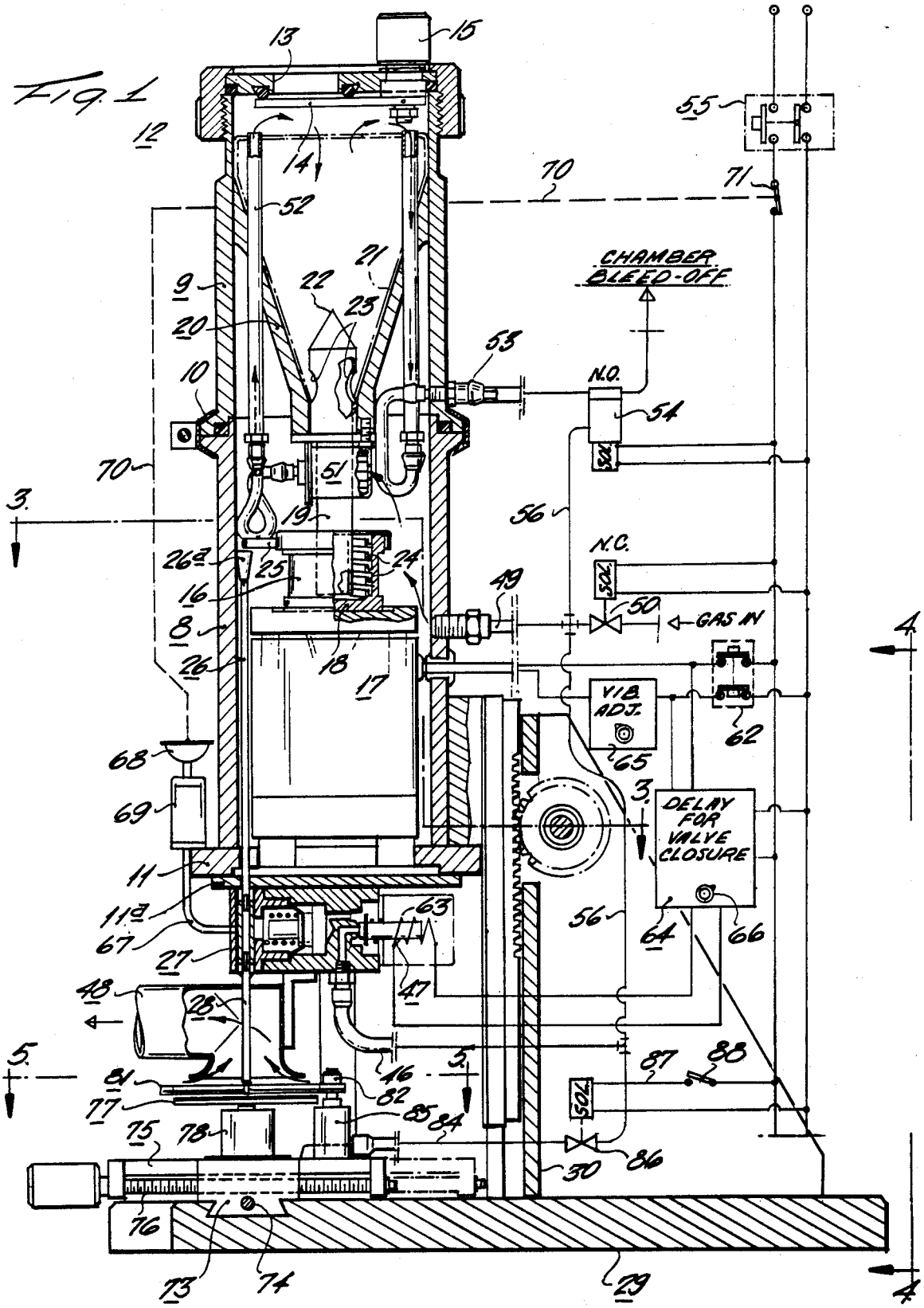
FIG. 1 is a vertical sectional view of an abrasive jet machine according to the present invention, including the vertical pressurized flow duct and the mechanism for delivering a uniform supply of abrasive particles into the vertical duct, together with a reserve abrasive particle or powder supply, this view also illustrating workpiece supporting means and certain control systems.

The abrasive particle storage, supply and feed mechanism is generally illustrated in FIG. 1, and it is here noted that the general arrangement of the feed mechanism and the associated storage chamber are similar to those features as disclosed in the companion application of Ben J. Gallant above fully identified. The equipment includes a pair of generally cylindrical components 8 and 9 which constitute a pressurized vessel in which the feed is effected and which also encloses a reserve supply of the particulate material being used. These cylindrical components are interconnected with a sealing ring 10 therebetween and constitute a unified pressure chamber, the lower end of which is closed by a wall 11, and the upper end of which is closed by a closure cap 12 having a threaded engagement with the upper edge of the cylinder 9, and further having an aperture 13 with a closure valve 14 adapted to be shiftably moved by means of the knob 15.

Toward the upper end of the lower cylindrical component 8, a cylindrical feed chamber 16 is mounted at the top of a vibrator 17, so that the vibratory motion of the vibrator is communicated to the feed chamber 16. It is contemplated that the vibrator 17 and the feed chamber 16 be mounted so as to vibrate substantially independently of the chamber components 8 and 9 and the mounting structure.

The feed chamber 16 has a bottom wall 18 which receives a deposit of abrasive powder to be fed from the vertical tube 19 which extends upwardly into the lower end of the conical wall 20 which defines the bottom of the reserve powder supply chamber in the upper end of the cylindrical component 9. A supply of powder may be introduced either through the aperture 13 in the upper cap 12 or by removal of the cap and then insertion of a supply, for instance, in a generally conical supply cartridge 21, formed, for example, of disposable paper, and with its lower end arranged to be pierced by the pointed component 22 in the bottom of the conical chamber 20, so that the powder in the reserve supply container will flow into the apertures 23 in the conical component 22, and thence downwardly through the vertical tube 19 to the bottom wall 18 of the feed chamber 16.

The lower end of the vertical feed tube 19 is closely spaced above the upper surface of the bottom wall 18 of the feed chamber 16, and this arrangement provides for uniformity of feed of the abrasive powder from the reserve supply in the manner more fully described in the copending application of Ben J. Gallant above fully identified.

Figure 3:
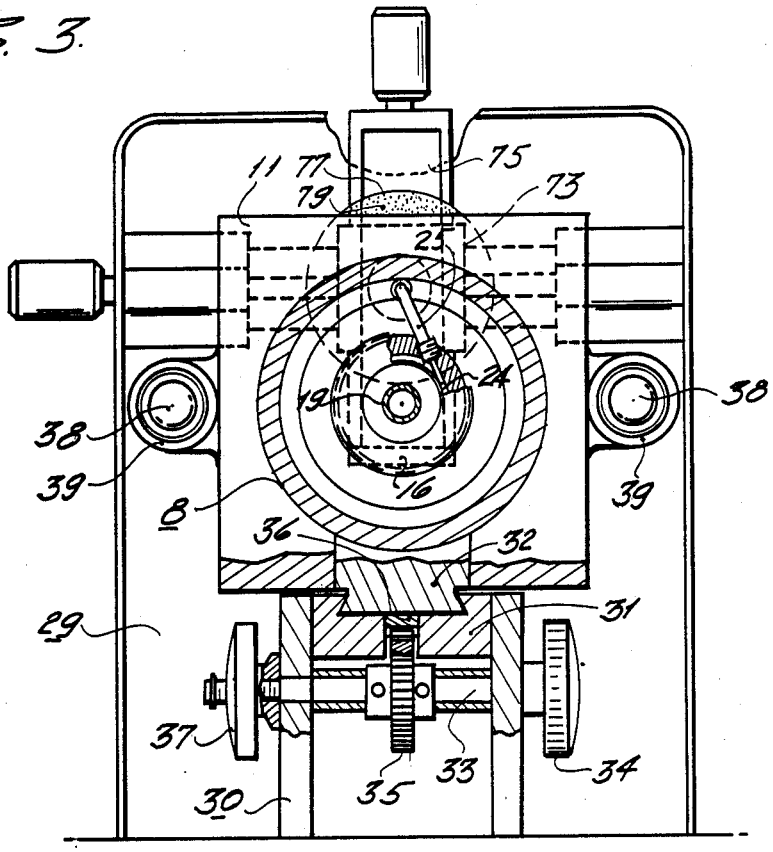
FIG. 3 is a transverse sectional view through equipment shown in FIG. 1, and taken on the line 3—3 on FIG. 1.

As in said copending application, a helical feed channel 24 is provided on the inside surface of the feed chamber 16, this arrangement being shown in both FIGS. 1 and 3, and the vibration of this unit under the action of the vibrator 17 results in upward feed of a stream of the abrasive particles to the upper end of the helical feed channel. In the upper region of the feed chamber 16, a delivery duct 25 is arranged, this delivery duct being extended substantially horizontally and tangentially with respect to the helical feed channel 24, and the delivery duct 25 is arranged to receive and transmit all of the powder material being fed upwardly in the helical channel 24. This arrangement functions in the manner fully set out in the copending application of Ben J. Gallant above identified.

In the arrangement of the present application, the delivery duct 25 (see particularly FIG. 1) discharges the particulate material in a zone above the entrance end of the vertical feed tube 26, which preferably has an enlargement or entrance funnel 26*a* at its upper end in order to ensure delivery of all of the powder being fed from the delivery duct 25 into the vertical tube 26.

Figures 1A, 1B, 2:
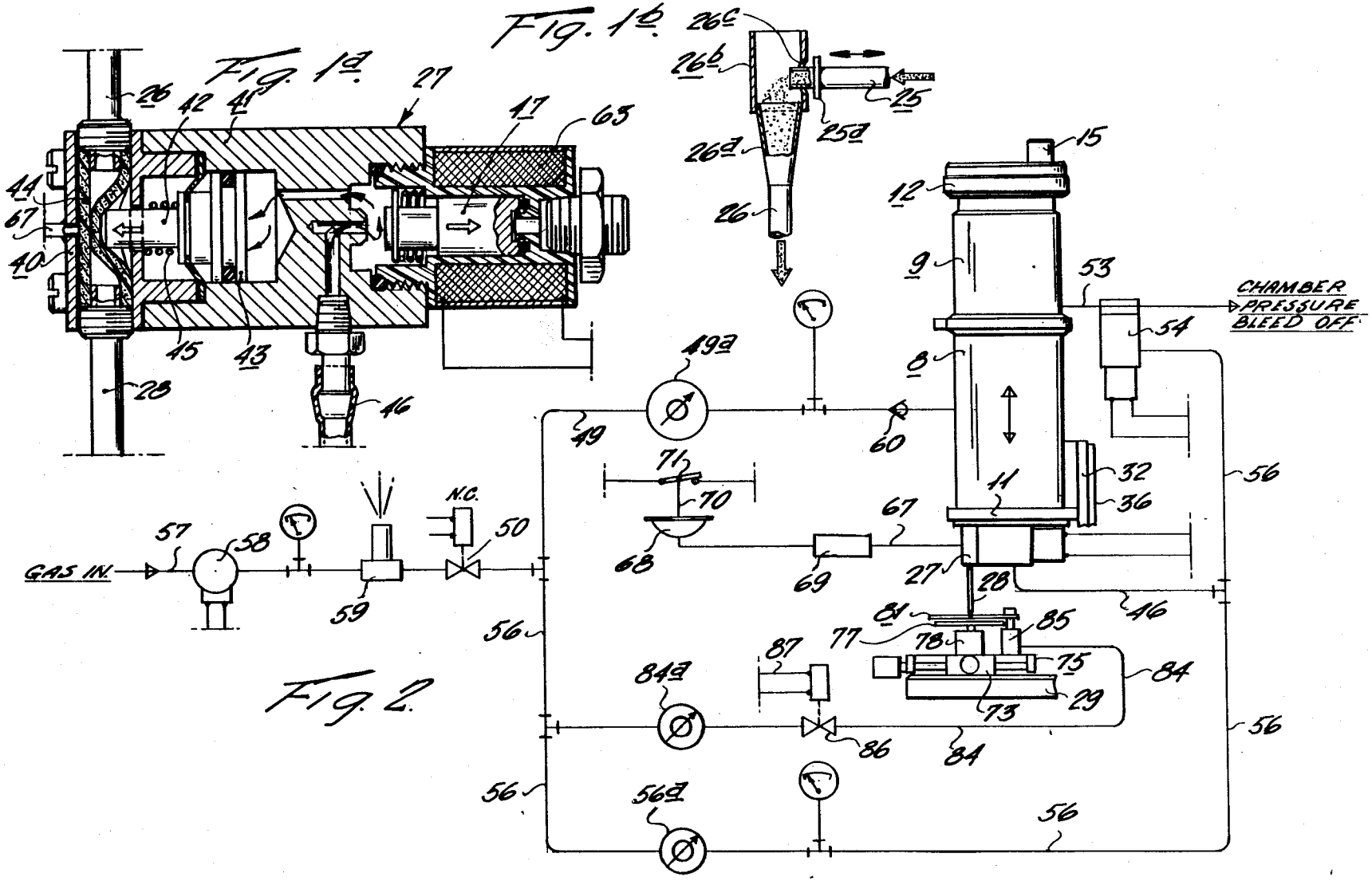
FIG. 1*a* is a sectional view of one of the control devices used in the system of FIG. 1.
FIG. 1*b* is a fragmentary view of an alternative arrangement of certain abrasive feeding parts shown in FIG. 1.
FIG. 2 is a schematic illustration of the pneumatic or pressure system preferably employed in connection with the equipment shown in FIG. 1.

FIG. 1*b* illustrates an alternative embodiment of the arrangement providing for communication of the delivery duct 25 extended from the vibrator to the upper end of the vertical feed tube 26. In this alternative arrangement, the entrance funnel 26*a* is provided with an upwardly extending and upwardly open sleeve 26*b* having an opening 26*c* in the side wall thereof in order to receive the delivery end of the delivery duct 25. Preferably, the opening 26*c* is slightly larger than the outside diameter of the duct 25 in order to permit entrance of pressurized gas from the surrounding area into the sleeve 26*b* and thus downwardly into the funnel 26*a* and the tube 26.

Preferably, a flange 25*a* is also secured to the delivery duct 25, and this flange may serve as a stop for limiting excessive movement of the duct 25 into the sleeve 26*b*. It is contemplated that the spacing of these parts (25, 26*b* and 25*a*) be such as to avoid engagement of the flange 25*a* with the sleeve 26*b* in a manner seriously impairing the vibratory motion of the duct 25 which is carried by the wall of the vibratory feed chamber 16. The upper end of the sleeve 26*b* is preferably open throughout its width for free entrance of pressurized gas entering the sleeve and entraining the particles of the abrasive material introduced through the delivery duct 25. The presence of the sleeve ensures entrainment of all of the powder particles being delivered from the delivery duct 25.

As will be seen from FIG. 1, the vertical feed tube 26 extends downwardly within the pressure chamber 8 and passes through the bottom wall 11 and the associated closure component 11*a*. The wall 11 serves as a structural support for the cylindrical components 8 and 9 of the pressurized chamber and also as a support for the vibrator 17 and the cylindrical feed chamber 16 which is mounted on the top of the vibrator, and the closure component 11*a*.

Figure 8:
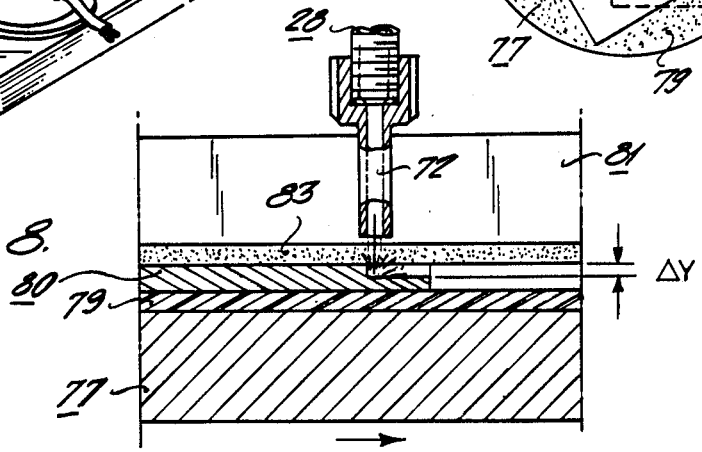
FIG. 8 is an enlarged detailed view of the delivery nozzle in relation to a workpiece and parts of the workpiece support.

The vertical feed tube 26 projects into the shutoff valve device indicated generally at 27, this device being described more fully hereinafter. It is here further pointed out that a feed tube 28 extends downwardly from the shut-off valve device 27, the tubes 26 and 28 being vertically aligned with each other and serving to deliver the stream of abrasive-laden pressurized gas downwardly to the work area. A downwardly directed nozzle is provided at the lower end of the feed tube 28, in order to deliver the abrasive stream downwardly against the surface of the workpiece being handled, as shown in FIG. 8 and described hereinafter.

Attention is now called to the fact that the structure above described is all supported on a base support 29. This base support serves to carry not only the workpiece supports described hereinafter, but also the cylindrical components 8 and 9 and the associated parts of the abrasive stream generating equipment.

Figure 4:
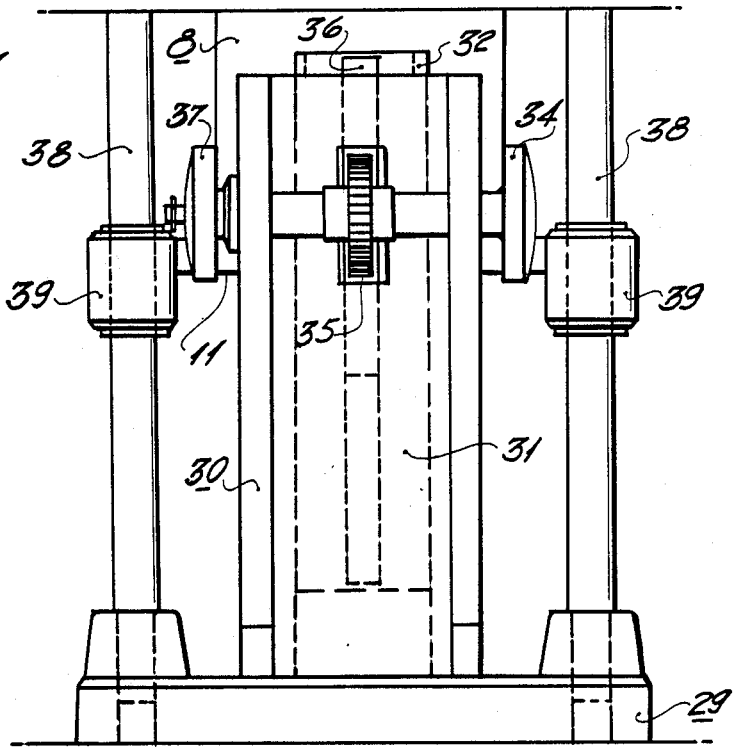
FIG. 4 is a fragmentary elevational view of portions of the mounting equipment, taken as indicated by the line 4—4 on FIG. 1.

By reference to FIGS. 1, 3 and 4, it will be seen that the base support 29 is provided with an upright supporting structure 30, this structure 30 comprising two spaced components with an intervening vertical track 31 cooperating with the support element 32 for the cylindrical pressure components 8 and 9, the element 32 being secured to the outside of the lower cylindrical component 8. By this mounting, provision is made for vertical movement of the support element 32 in relation to the vertical track 31, thereby providing for vertical adjustment movement of the pressurized feed mechanism with respect to the base 29. The upright supporting structures 30 may be apertured to cooperate with a transversely extending control shaft 33 having an knurled adjustment handle 34. This shaft 33 carries a gear 35 meshing with a rack 36 carried by the support element 32, and thereby providing for vertical adjustment movement of the pressurized feed mechanism by manual rotation of the adjustment handle 34. A locking device 37 may be provided in order to retain the mechanism in any position of vertical adjustment.

To add stability in the vertical support and movement of the pressurized mechanism for developing the abrasive gas stream, vertical guide posts 38 may be provided, the posts being mounted on the base 29, and guide sleeves 39 cooperating with the posts may be connected with the bottom wall 11 on which the cylindrical components 8 and 9 are mounted.

The delivery of the abrasive-laden pressurized gas stream downwardly from the nozzle at the lower end of the lower section of the feed tube 28 is controlled by means of a solenoid-operated shut-off valve device indicated generally at 27 and shown in FIGS. 1 and 1*a* as comprising a block 40 having a vertical bore therethrough, the upper portion 26 of the vertical feed tube being connected with the upper end of the bore in the block 40, the lower portion 28 of the vertical feed tube being connected with the lower end of the bore in the block 40. The body 41 of the shut-off valve is provided with a cavity in which the control plunger 42 is arranged, the plunger projecting from one side of the piston 43. The plunger 42 is adapted to be shifted toward and away from the bore in the block 40, and the bore 40 is lined with a resilient sleeve 44. The sleeve has a central passage with which the aligned vertical tubes 26 and 28 are connected; and the plunger 42 serves as a shut-off valve by transversely collapsing the sleeve 44. A spring 45 normally urges the piston 43 to the right, which corresponds to the valveopen position, and the piston is adapted to be moved to the right by admission of pressurized operating gas, derived, for instance, from the connection 46 communicating with passages within the body 41 of the shut-off valve in order to shift the piston 43 to the left, as viewed in FIGS. 1 and 1*a*. The supply connection 46 for the operating gas is controlled by a solenoid-operated plunger 47 supplied with current in the manner described hereinafter in connection with the control system for starting and stopping the abrasive operation. The shut-off valve device 27 is mounted on the underside of the bottom closure wall 11*a*, and, therefore, moves vertically with the pressurized abrasive feed system.

The vertical positioning of the tubes 26 and 28 and of the intervening pinch tube or sleeve 44 and the use of a sleeve 44 of larger inside diameter than the inside diameter of the tubes 26 and 28, reduces wear of the sleeve even when operating at very high pressures and velocities.

Attention is also called to the fact that a suction device 48 (see FIG. 1) with a downwardly open inlet opening in the region of the nozzle tip of the vertical feed tube 28 is connected with the body of the shut-off device 27 and, therefore, moves vertically with the vertical adjustment of the mechanism for developing the abrasiveladen air stream. This suction device will entrain and deliver abrasive particles and dust from the abrasion, and will effectively perform that function because of its mounting for vertical adjustment movement with the vertical feed tube and the mechanism for developing the pressurized abrasive stream.

Attention is now directed to the fluid pressure connections provided for the purpose of developing the operating pressure within the cylindrical chamber components 8 and 9, and it is here noted that these connections are essentially the same as those disclosed in the copending application of Ben J. Gallant fully identified above. Briefly, as shown in FIG. 1, the connections include the supply line 49 having normally closed solenoid-operated main inlet valve 50. Compressed operating gas, normally air, is introduced into the pressure chamber in this manner, and after passing through a filter 51, flows through the tube 52 into the upper region of the upper pressure cylinder 9, thereby pressurizing the space in the reserve supply chamber provided within the conical wall 20. When the system is depressurized, the gas will be delivered or discharged through the connection 53, this delivery being effected through the solenoid-operated bleed-off valve 54. The supply and bleed-off valves 50 and 54 are controlled by the master control switch indicated at 55. Attention is now called to the fact that pressurized gas is also delivered to the connection 46 of the shut-off valve 27 through the branch air supply line 56.

The above described air supply and bleed-off system is also illustrated somewhat diagrammatically in the schematic view of FIG. 2. Here, the pressurized gas supply line is indicated at 57. After passing through the pressure regulator 58 and through a relief valve 59, the pressurized gas passes through the main inlet control valve 50 above referred to and then is delivered to several branch lines, including the branch line 49 which is the air supply line delivering air into the pressurized chamber 8 through the check valve 60. An adjustable pressure regulator 49*a* may be provided in the line 49. The branch line 56 supplies pressurized air to the connection 46 for supplying pressurized air to the piston 43 in the shut-off device 27. This line may also serve to supply operating pressure to the bleed-off or discharge solenoid 54 and may contain an adjustable pressure regulator 56*a*.

Referring again to FIGS. 1 and 1*a*, attention is now called to the shut-off switch 62 for starting and stopping the vibration of the vibrator 17. This switch 62, in effect, constitutes a master control switch by means of which (after the system is pressurized) the abrasive operation is started and stopped at the will of the operator or at the will of computer-controlled equipment, depending upon the installation. For the purpose of effecting feed of the powder material, it is also necessary to open the solenoid-operated shut-off valve 27 which is associated with the vertical feed tube 26, 28. This control is effected by the solenoid winding 63 which is associated with the solenoid plunger 47. The circuit to this winding 63 is connected with the control box 64 which is activated under the influence of the start-stop control switch 62.

Attention is further directed to the fact that the operating circuit to the vibrator 17 is provided with an adjusting device 65 by which the speed or intensity of the vibration may be adjusted, thereby adapting the equipment to the feed of different quantities of abrasive material and also providing for adjustment to accommodate the use of abrasive materials of different particle size or different weight characteristics.

Another adjusting device indicated at 66 is also provided in the control box 64 for the shut-off valve 27, and this adjustment serves a special function, described just below.

In further explanation of the start-stop control system above referred to, attention is now directed to the fact that the shut-off device 27 for the vertical feed tube 26, 28 is positioned close to the delivery nozzle of the delivery duct. According to the present invention, provision is made for assuring discharge of all of the powder contained in the delivery passages at the time when the vibrator 17 is shut-off, thereby avoiding accumulation of powder in the vertical feed tube. This requires that the delivery tube be retained in open condition until after the powder has been discharged; and to assure that the closure of the shut-off valve 27 does not occur until after the powder has all been discharged, the control box 64 embodies a delay circuit which retains the solenoid-operated plunger 47 in closed position for an interval of time after the opening of the master on-off switch 62. This time delay device may be adjusted by means of an adjustable control 66 provided on the box 64. At the time of closure of the main on-off switch 62, in order to again initiate the abrasive flow, it is desirable that the vibration of the unit 17 and the opening of the valve 27 occur substantially concurrently, in order to avoid "back-up" of powder in the system being fed by the cylindrical feed chamber 16.

Attention is now called to the fact that except for the resilient sleeve 44 in the shut-off valve 27, the entire abrasive powder feed system is embodied in metallic, carbide or similar rigid tubing, rather than tubing formed of plastic or other flexible material. Preferably, these tube elements are made of hard metals, carbides or the like as above mentioned. The vertical alignment of the components of this delivery system and the employment of the metallic and preferably carbide tubes makes possible large increase in the pressure employed in the system, as compared with prior art systems. The straight line and preferably downwardly directed delivery or feed tube 26, 28 greatly reduces abrasion tendancy in the delivery system, even when employing very high pressures and velocities. The resilient sleeve 44 surrounds the adjacent terminal ends of the vertical feed tubes 26 and 28, and the resilient sleeve thus has an inside diameter somewhat greater than the inside diameter of the tubing itself. This also facilitates employment of higher pressures, without impractical wear rate within the resilient sleeve.

However, the resilient sleeve may deteriorate over a period of time, and provision is made in the system herein disclosed to call attention to the wear of the resilient sleeve and thereby provide for its replacement when needed. For this purpose, the bore in the block 40 of the valve device 27 is provided with an aperture communicating with a duct 67 (see FIGS. 1, 1*a* and 2). This duct communicates with a pressure sensitive element 68 through a filter 69, and this device is mechanically connected as indicated at 70 with the emergency shut-off switch 71. From FIG. 1, it will be noted that this emergency shut-off not only stops the vibration and powder feed, but also opens the circuit through the master control switch 55, in view of which the input of pressurized gas will be terminated and the air pressure in the chamber 8-9 will be discharged. This will prevent leakage of pressurized gas and abrasive particles and establishes a condition appropriate to the opening of the shut-off valve 27 and the replacement of the flexible sleeve 44.

As appears in FIGS. 1, 5, 6, 7 and 8, the base 29 also is preferably used to mount a workpiece support. These components may be arranged in a variety of ways, but it is preferred that the mechanism described above for developing the abrasive stream and the work support both be mounted on a common base, and preferably, be mounted for independent adjustment movements. Thus, it is contemplated that the abrasive stream producing mechanism be mounted for vertical movement, in the manner already described above, in relation to the work support, thereby avoiding any need for the employment of a flexible connection in the delivery duct upstream of the abrasive nozzle. Note that in FIG. 8, the lower end of the lower feed tube 28 is associated with a nozzle 72, and it is contemplated that the motion of the workpiece, whether rotative or reciprocative, be arranged on adjustably moveable support mechanism carried by the base 29. In order to provide alternatively for several different types of abrading motions, a carriage 73 is mounted for adjustment movement on the base 29 by means of the threaded feed screw 74. The carriage 73 serves as a mounting for the support 75, the support 75 also being adjustably moveable in a direction transverse to the direction of movement of the carriage 73, as by the controllable feed screw 76.

For certain types of abrasive operations, the workpiece may be mounted upon the support 75 for selected shifting movements in the two directions provided by the two feed screws 74 and 76, and in this way, different areas of the workpiece may be brought under the delivery nozzle 72.

It is further contemplated that for certain purposes, a rotative platform for supporting a workpiece may be provided, as indicated in the drawings at 77. This platform may be mounted on the support 75 by means of a motor 78 by means of which the rotatable support may be turned in order to provide a rotative motion of the workpiece in relation to the nozzle 72. The rotative platform 77 may be covered with resilient layer indicated at 79 on which the workpiece, for instance, the square wafer 80, may be mounted for purposes of dicing.

Figure 5:
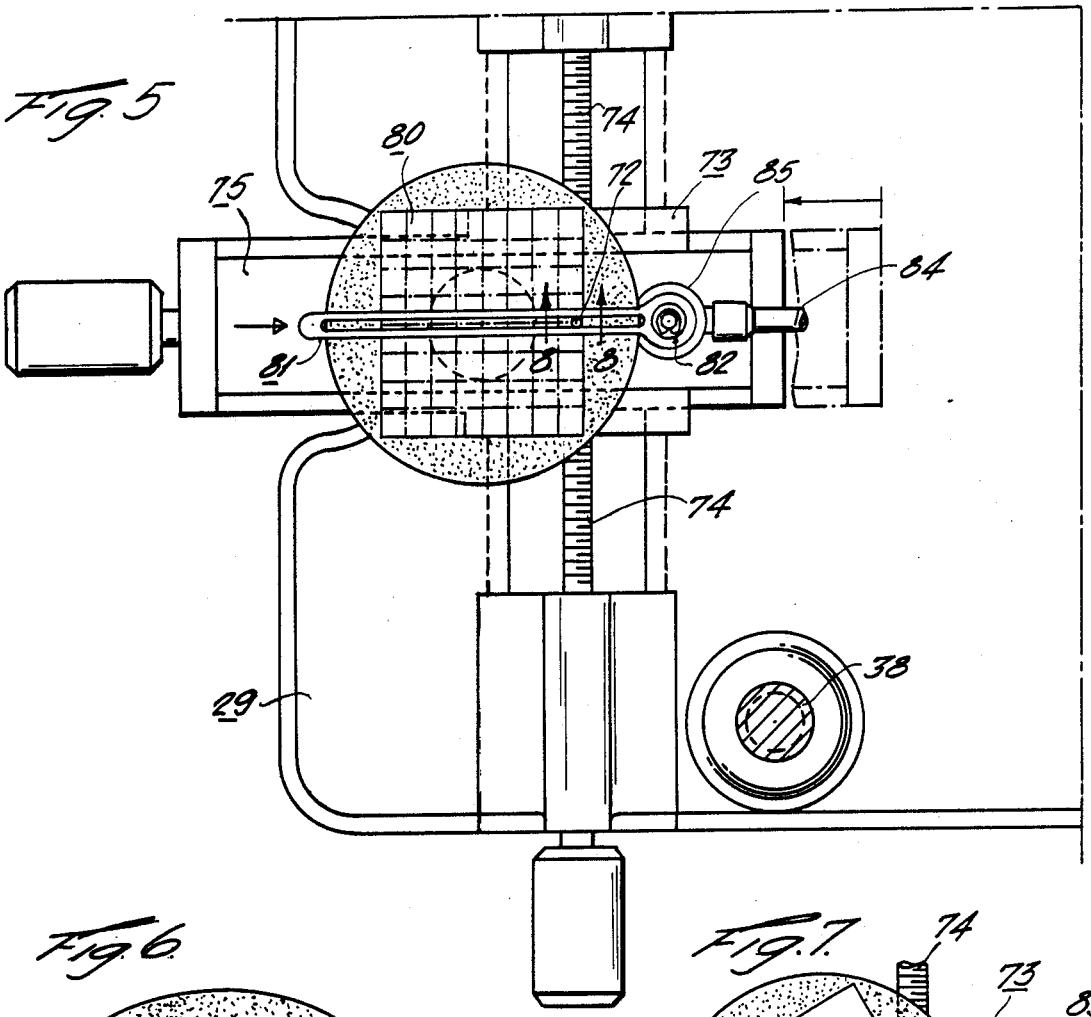
FIG. 5 is a horizontal sectional view, taken as indicated by the section line 5—5 on FIG. 1, and particularly showing portions of the work support and the mounting and control mechanisms provided for the work support.
Figure 6:
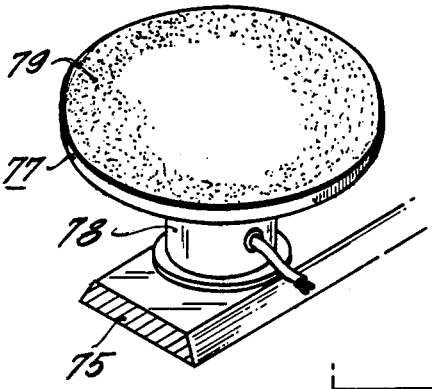
FIG. 6 is an isometric fragmentary view illustrating a work support of the kind shown in FIGS. 1 and 5.
Figure 7:
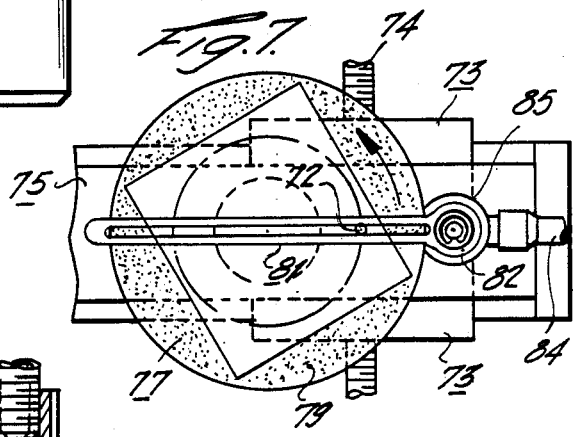
FIG. 7 is a plan view of portions of equipment shown in FIG. 5, but with certain parts in different positions.

For the purpose of stabilizing and holding a workpiece on the supporting table, a slotted holding arm indicated at 81 may be pivotally mounted by a support 82, which may be arranged to provide for clamping of the workpiece against the resilient cover 79, thereby holding the workpiece in the desired position for effecting the particular abrading operation required. The tip portion of the abrasion nozzle 72 may project downwardly through the slot in the holding arm 81, as indicated in FIGS. 5, 7 and 8. The slotted holding arm 81 desirably has a rubber or resilient coating on its undersurface, as indicated at 83 in FIG. 8.

In FIG. 8, the workpiece 80 is shown as being subjected to a slotting operation, but, if desired, the abrasive stream may be used for the purpose of completely severing the workpiece, i.e., cutting the workpiece into separate parts.

It will be understood that the motions of the work support may be controlled in any of a variety of ways, either manually or automatically by computerization, and in connection with the depth of cutting of the workpiece, provision may be made for automatically controlling the vertical position of the nozzle and the abrasive stream generating mechanism. This vertical movement is provided for by the adjustable gear 35 engaging the rack 36.

As will be seen from FIGS. 1 and 2, the pressure supply line 56 is still further provided with a branch 84 which extends to the mounting device 85 on which the holding arm (81) is supported and by which the holding arm may be shifted vertically in order to bring it into clamping action with the workpiece on the table support 77. The pressure supply line 84 may be provided with a pressure adjuster **84*a* and also with a solenoid-operated shut-off valve 86, this valve providing for delivery of operating gas to the device 85 by pressure supplied from the line 56. The solenoid valve 86 will be controlled by the circuit indicated at 87 having a control switch 88 (see FIG. 1**).

We claim:

1. Apparatus for developing and handling an abrasive-laden gas stream, comprising a substantially vertical feed tube having an upwardly directed inlet opening at its upper end and having a downwardly directed delivery nozzle at its lower end with a downwardly directed delivery nozzle opening, said vertical tube and said nozzle having coaxial passages, a pneumatically pressurized receptacle in which said upwardly directed inlet opening is exposed, the receptacle having a lower closure through which the feed tube extends, a vibratory feed chamber in said pressurized receptacle, the feed chamber having a delivery duct adapted to feed a stream of particulate material into the upwardly directed inlet opening of said feed tube to provide for carrying the particulate material in a stream of gas downwardly through said tube to a region externally below said pressurized receptacle, the feed tube including vertically and axially aligned rigid tube elements with adjoining ends presented toward and spaced from each other in said region externally below said pressurized receptacle, and a flow shut-off valve in the region of the space between said vertically aligned tube elements, the shut-off device including a vertically extended tube formed of resilient material and having an inside diameter sufficient to engage and telescopically overlap the ends of the vertically aligned tube elements, rigid means surrounding the tube formed of resilient material and rigidly interconnecting the adjoining ends of said vertically aligned tube elements and a shut-off plunger positioned to horizontally pinch the resilient tube in said region below said pressurized receptacle.

2. Apparatus for developing and handling an abrasive-laden gas stream, comprising a feed tube formed of rigid tube elements axially aligned but spaced from each other, a flexible and laterally collapsible tube element bridging the space between the rigid tube elements and axially aligned with and interconnecting said rigid tube elements, mechanism for delivering a pressurized abrasive-laden gas stream into one end of the feed tube for serial passage through the rigid and collapsible tube elements, controllable means for laterally collapsing said collapsible tube element, controllable means for starting and stopping the delivery of the pressurized abrasive-laden gas stream into the feed tube, and means responsive to rupture of said collapsible tube element for actuating said controllable means to stop delivery of the pressurized abrasive-laden gas stream into the feed tube.

3. Apparatus for developing and handling an abrasive-laden gas stream, comprising a substantially vertical feed tube having an inlet opening at its upper end and having a downwardly directed delivery nozzle at its lower end with a downwardly directed delivery nozzle opening, said vertical tube and said nozzle having coaxial passages, a pneumatically pressurized receptacle in which said upwardly directed inlet opening its exposed, the receptacle having a lower closure through which the feed tube extends, a vibratory feed chamber in said pressurized receptacle, an upwardly open inlet sleeve in the pressurized receptacle, the inlet sleeve having a diameter larger than the inlet opening of said vertical feed tube and being extended above and connected with the upper end of the vertical feed tube, the vibratory feed chamber having a delivery duct connected to vibrate with the vibratory feed chamber and positioned to feed a stream of particulate material through the side wall of the upwardly open inlet sleeve and from the sleeve into the inlet opening of said feed tube to provide for carrying the particulate material in a stream of gas downwardly through said tube for discharge through said delivery nozzle.

4. Apparatus as defined in claim 3 in which the side wall of said sleeve has an aperture through which the delivery duct extends into the interior of the sleeve, said aperture being of larger cross section than the external dimension of the delivery duct to provide for entrance of pressurized gas from the pneumatically pressurized receptacle through said aperture in the region surrounding said delivery duct.

5. Apparatus as defined in claim 3 in which said inlet sleeve further has an upwardly, flared, funnel-shaped connection between the upper end of the feed tube and the lower end of the inlet sleeve.

* * * * *